United States Patent [19]

Bond

[11] 4,190,214

[45] Feb. 26, 1980

[54] PACKAGE CONSTRUCTION FOR COILABLE MATERIAL AND METHOD OF PACKAGING AND DISPENSING SAME

[75] Inventor: Jerome S. Bond, Dayton, Ohio

[73] Assignee: Dayco Corporation, Dayton, Ohio

[21] Appl. No.: 957,278

[22] Filed: Nov. 2, 1978

[51] Int. Cl.[2] ..... B65H 49/18

[52] U.S. Cl. ..... 242/138; 206/397

[58] Field of Search ..... 242/54 R, 55, 54, 128, 242/129, 137–138, 146, 171; 206/389–395, 402, 407; 222/94, 99, 100

[56] References Cited

U.S. PATENT DOCUMENTS

| | | | |
|---|---|---|---|
| 3,041,006 | 6/1962 | Eckert | 242/128 |
| 3,059,763 | 10/1962 | Eifrid | 206/400 |
| 3,298,631 | 1/1967 | Richardson, Jr. | 242/129 |
| 3,464,647 | 9/1969 | Jacobi | 242/129 |

*Primary Examiner*—Leonard D. Christian
*Attorney, Agent, or Firm*—Reuben Wolk

[57] ABSTRACT

A package construction for coilable material and method of packaging and dispensing such coilable material are provided wherein the package construction comprises a reel for coiling the coilable material thereon and a pallet-type support means for the reel with the reel being made as a part of the support means and the support means supporting the reel for handling and storage purposes and also supporting the reel for rotation relative thereto.

23 Claims, 15 Drawing Figures

PACKAGE CONSTRUCTION FOR COILABLE MATERIAL AND METHOD OF PACKAGING AND DISPENSING SAME

BACKGROUND OF THE INVENTION

1. Field of the Invention

This invention relates to a package construction for coilable material of the type coiled on a reel thereof.

2. Prior Art Statement

It is known to provide a coilable material such as hose, tubing, electrical cable, wire, rope, sheet material of all types, and the like, on a reel thereof for shipping, storage, and handling. Once it is desired to use the coilable material on such reel the reel is placed on a rotatable device such as a mandrel, or the like, and desired lengths unwound and cut from the material wound on such reel.

However, reels of this type often are difficult to handle and place on a rotatable mandrel for dispensing purposes, and then store after dispensing some of the material. Also, because of the weight of the reel of a particular material it is often necessary to handle such reel by placing same on a pallet and handling with a material handling device such as a forklift truck.

SUMMARY

It is a feature of this invention to provide an improved package construction for coilable material which is of optimum simplicity.

Another feature of this invention is to provide a package construction for coilable material comprising a reel for coiling the coilable material thereon and a pallet-type support means for the reel with the reel being made as a part of the support means and the support means supporting the reel on an end thereof for handling and storage purposes and also supporting the reel for rotation relative thereto.

Another feature of this invention is to provide a package construction for coilable material comprising a reel for coiling the coilable material thereon and a container for containing such reel with the container comprising a plurality of walls wherein the reel is made as a part of one of the walls.

Another feature of this invention is to provide a package construction of the character mentioned wherein the one wall of the container is provided with a plurality of feet whereby such one wall and its feet also define a pallet for the container and its reel which is particularly adapted to be handled by a material handling device such as a lift truck, or the like.

Another feature of this invention is to provide a package construction of the character mentioned made of economical material.

Another feature of this invention is to provide a package construction of the character mentioned wherein the one wall with its feet define a pallet for the container and its reel and wherein such reel may be suitably supported for unwinding rotation on the one wall in an upright manner for dispensing purposes and an open-ended tubular construction comprises the package construction and is simply lifted away from the one wall and returned thereto to respectively expose and enclose the reel on its one wall.

Another feature of this invention is to provide a package construction of the character mentioned with the reel made as a part of the one wall and wherein such reel and its one wall may be supported on a conventional support for unwinding rotation and dispensing of coilable material carried on the reel.

Another feature of this invention is to provide an improved method of packaging and dispensing coilable material employing a package construction of the character mentioned.

Another feature of this invention is to provide an improved method of packaging and dispensing coilable material employing a package construction of the character mentioned wherein such package construction is also stored in a simple and economical manner due to its stacking capabilities.

Another feature of this invention is to provide a method of packaging and dispensing coilable material wherein a reel of coilable material is supported on an end on a pallet-type support means for the reel with the reel being made as a part of the support means and the support means supporting the reel for handling and storage purposes and also supporting the reel for rotation relative thereto.

Another feature of this invention is to provide a method of packaging and dispensing coilable material wherein a reel of coilable material is supported on a pallet-type structure which defines a wall of a container for the reel as well as a pallet for such container and such structure also serves as a support which supports the reel thereon for unwinding rotation with such reel disposed with its longitudinal axis extending vertically.

Therefore, it is an object of this invention to provide an improved package construction and a method of packaging and dispensing coilable material having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
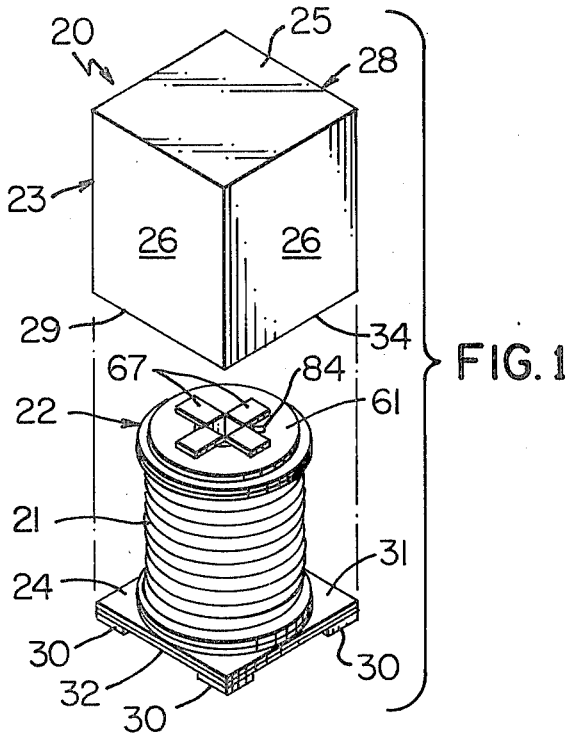
FIG. 1 is an exploded perspective view showing a reel having a coilable material coiled thereon and a container for containing the reel with the reel being made as a part of one of the walls of the container and with the one wall serving the dual purpose of wall and pallet for the package construction.

Reference is now made to FIG. 1 of the drawing which illustrates one exemplary embodiment of a package construction of this invention which is designated generally by the reference numeral 20 and such package construction is particularly adapted for packaging coilable material shown in this embodiment as coilable polymeric tubing or hose and designated by the reference numberal 21. The package construction 20 of this example comprises a reel 22 for coiling the coilable material thereon and a container designated generally by the reference numeral 23 for containing the reel 22 with its supply of coilable material or polymeric hose 21.

The container 23 is comprised of a plurality of walls shown as a bottom wall 24, a top wall 25, and a plurality of side walls, each designated by the same reference numeral 26, suitably interconnected to the top wall 25 with the top wall 25 and side walls 26 cooperating to define an open-ended tubular construction 28 having an open end which will be designated by the reference numeral 29. In accordance with the teachings of this invention the reel 22 is made as a part of one of the walls of container 23 and in this example is shown made as part of the bottom wall 24.

It is also in accordance with the teachings of this invention to consider the bottom wall 24 as a pallet-type support means 24 for the reel 22 with the reel being made as a part thereof, and the support means 24 supporting the reel 22 for handling and storage purposes and also supporting the reel for rotation relative thereto as will be apparent from the following description.

Figure 5:
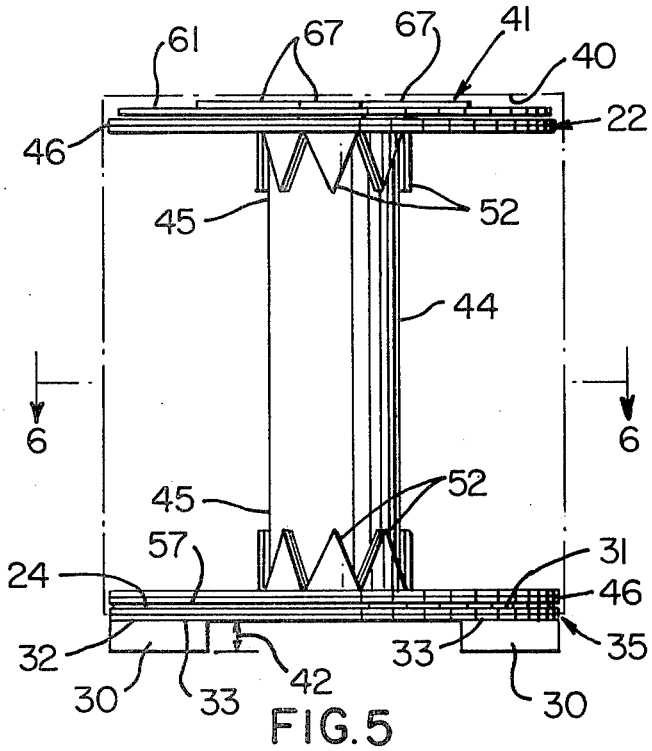
FIG. 5 is a view in elevation of an empty reel which is made as a part of the dual purpose wall and pallet of the package construction of FIG. 1 and showing by dot-dash lines the manner in which an open-ended tubular construction of the package construction is telescoped in position therearound.
Figure 6:
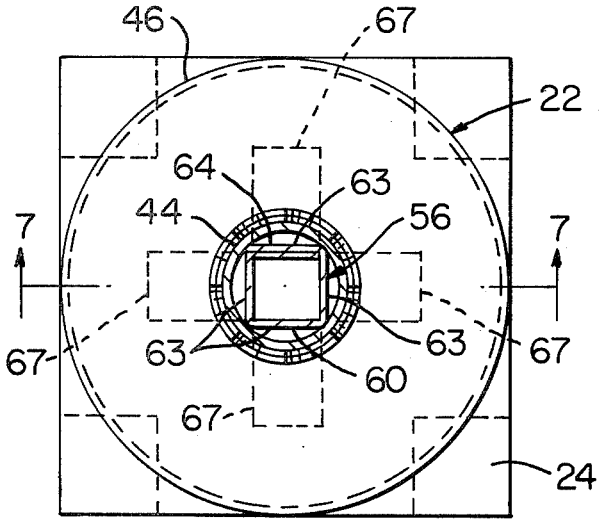
FIG. 6 is a view taken essentially on the line 6—6 of FIG. 5.

As will be readily apparent from FIGS. 1 and 5 of the drawings, the one wall or bottom wall 24 has a plurality of feet 30 thereon whereby such bottom wall 24 and its feet 30 define a pallet for the container 23 and its reel 22. The bottom wall 24 also has an inner surface 31 and an outer surface 32 and the feet 30 are disposed against the outer surface 32 and suitably bonded or fixed thereagainst using any technique known in the art. In this example of the invention, the bottom wall 24 is of rectangular peripheral outline, preferably in the form of a square, and the feet 30 are fixed in position at the corners thereof by suitable fixing means such as adhesive means 33.

The reel 22 is disposed substantially centrally on the bottom wall 24 and the open-ended tubular construction is disposed around the reel 22 and around the peripheral outline of the bottom wall 24 with the terminal edge 34 of the open-ended tubular construction disposed above the outer surface 32 and as shown at 35 in FIG. 5. The package construction 20 also has suitable fastening means shown in this example as fastening tape 36 which is used to fasten the open-ended tubular construction 28 thereof in position and preferably to the bottom wall 24 and with the terminal edge 34 of the open end 29 of such open-ended construction 28 above the outer surface 32 of the bottom wall 24 as mentioned above. The tape 36 may extend between the central part of each side wall 26 and the bottom wall 24.

Figure 2:
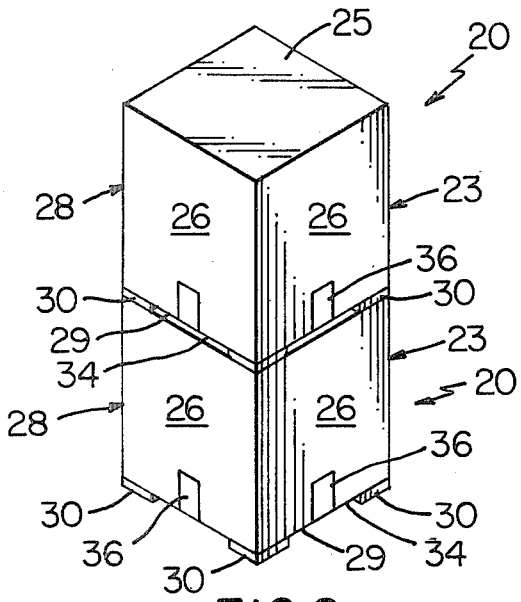
FIG. 2 is a perspective view illustrating the ease with which a plurality of two package constructions of this invention may be stacked for storage and/or handling.

With the above-described arrangement it will be seen that the top wall 25 has an inside surface 40 disposed against a top portion of the reel 22 as shown at 41 in FIG. 5, whereby it is a simple matter to stack a plurality of package constructions 20, as shown in FIG. 2, with optimum stability. Further, it will be appreciated that weight of each individual package construction 20 is carried by its dual-purpose bottom wall and pallet; and, the weight of a stacked package construction 20 is carried by the reel 22 and bottom wall 24 of a package construction disposed therebeneath with the side walls 26 of the tubular construction 28 being essentially load or stress free.

The feet 30 have a height 42 which defines a space of corresponding height between a supporting floor, or the like, and the outer surface 32 of the associated bottom wall 24. This space defined by the height 42 of the feet enables lifting members or fingers of a forklift truck, or the like, to be inserted in such space to enable lifting of the package construction 20 for transporting, stacking, and similar purposes.

Figure 8:
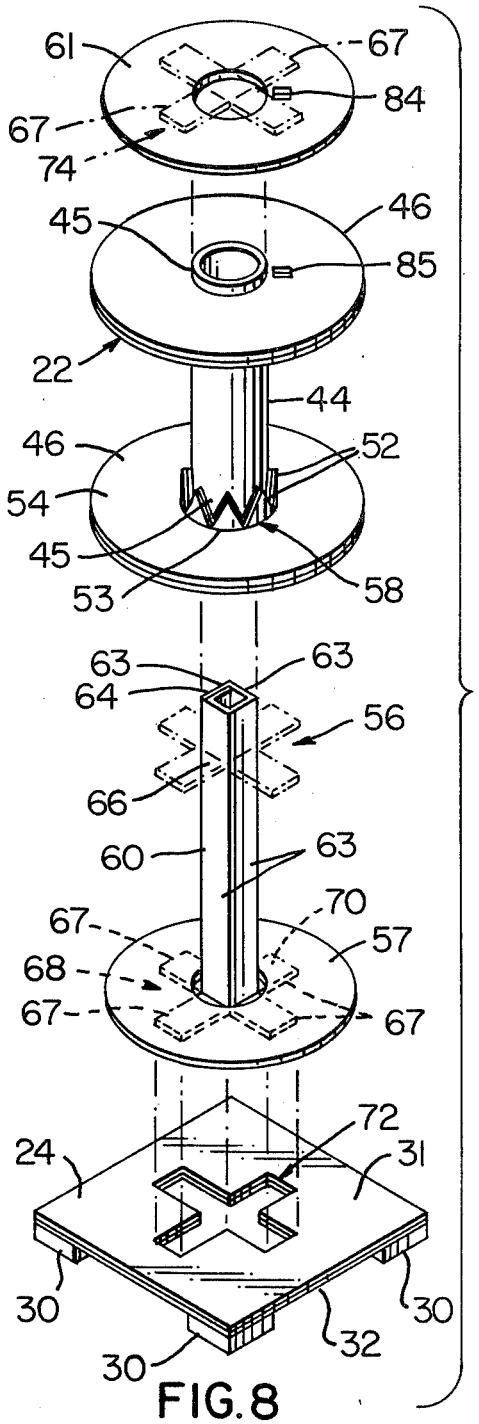
FIG. 8 is an exploded perspective view of the reel of FIG. 7, its associated one wall, and a shaft supporting the reel on the one wall.
Figure 7:
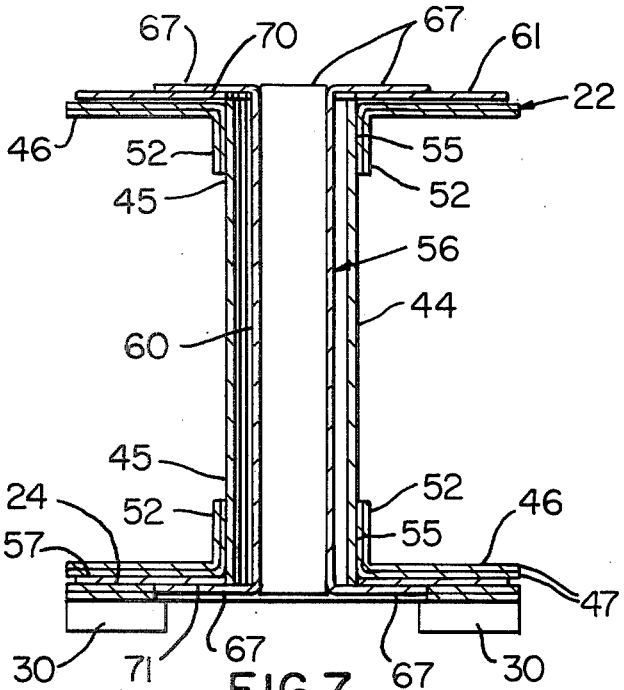
FIG. 7 is a cross-sectional view taken essentially on the line 7—7 of FIG. 6.

Referring now to FIGS. 7 and 8 of the drawing, it will be seen that the reel 22 comprises a tubular central core 44 which has a pair of opposite ends 45 and such reel has a pair of substantially planar retaining flanges for the coilable material or hose 21 with each flange being designated by the same reference numeral 46. The flanges 46 are fixed to the opposite ends 45 in substantially parallel relation and one of the flanges is disposed immediately adjacent the inner surface 31 of the bottom wall 24.

Figure 9:
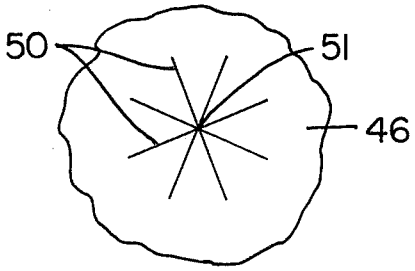
FIG. 9 is a fragmentary view of a central portion of a circular disc employed in making a retaining flange of the reel of FIG. 7 and with slits in such disc extending radially from the center thereof for the purpose of defining triangular tabs employed in fastening the flange-defining disc to a central core of the reel.

The reel 22 and all component portions thereof may be made of any suitable material known in the art and in this exemplary embodiment are made of a non-metallic material such as paper which may be in the form of corrugated paperboard. Each of the flanges 46 is defined as a circular disc in the form of a double-thickness disc with each thickness thereof being designated by the reference numeral 47. As seen in FIG. 9 each of the flanges 46 has a plurality of slits 50 therethrough extending radially from the center 51 thereof and the slits in each disc 46 define triangular tabs each designated by the same reference numeral 52. The tabs 52 are adpated to be folded about their bases 53 perpendicular to the peripheral portion 54 of their disc. To aid in this folding action suitable arcuate score means may be provided in each disc to define the bases 53 of tabs 52. The arcuate score means flow smoothly together at their opposite ends to define a circular score line 58 the diameter of which is controlled so that once the tabs 52 are folded perpendicular to their peripheral portion 54 the inside surfaces of such tabs are disposed snugly against the outside surface of the tubular central core 44 of the reel 22.

Suitable means is provided for fixing the tabs 52 in position against the core 44 and although such means may be in the form of rivets, staples, or the like, in this example an adhesive 55 is provided and used to fasten the tabs 52 against the tubular central core 44.

Referring again to FIG. 8 of the drawings, it is seen that the package construction 20 has means supporting the reel 22 for rotation relative to a bottom wall 24 and such supporting means is designated by the general reference numeral 56. The supporting means 56 comprises a circular disc member 57 which supports the lowermost retaining flange 46 and hence the reel 22 for sliding rotation thereon. The supporting means 56 for the reel 22 also comprises a support shaft 60 which is attached to the pallet-type bottom wall 24 and inasmuch as the central core 44 of reel 22 is a tubular core, the shaft 60 is disposed therethrough once such shaft is fixed to bottom wall 24.

The support shaft 60 of this example is in the form of a tubular shaft of rectangular peripheral outline and such shaft has means holding the reel 22 thereon against axial movement and such holding means is in the form of another disc 61 and associated rectangular tabs 67 which comprise an integral part of the tubular shaft 60 and as shown in FIG. 8. The rectangular tubular shaft 60 is made of a rectangular sheet of foldable material which defines the four walls thereof with each wall being designated by the same reference numeral 63; and, it is seen that the four walls 63 are foldably connected with one of the walls being a double thickness wall as shown at 64 due to the method of making the shaft 60.

Figure 10:
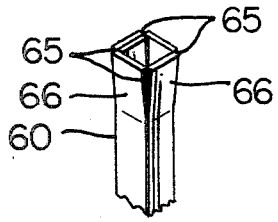
FIG. 10 is a fragmentary perspective view showing the manner of providing axial cuts in a typical end portion of the support shaft employed to support the reel on the dual-purpose wall and pallet of the package construction for the purpose of supporting and holding the reel on such wall.

The shaft 60 has four axially extending slits 65 along its four corners at each end portion 66 thereof and such slits are shown in a typical end portion 66 of the shaft 60 in FIG. 10 with the illustrated end portion 66 being substantially the same at both ends of such shaft. The four slits 65 in each end portion 66 define a set of four fastening tabs each designated by the same reference numeral 67.

One set of fastening tabs, shown as a bottom set 68, is folded perpendicular to its associated walls and attached to the bottom wall 24 to thereby attach the tubular shaft 60 to wall 24 in an upright manner and substantially perpendicular thereto. The attaching is preferably achieved by fixing the inside surfaces of the tabs 67 associated with the bottom wall 24 against the bottom surface of the disc 57 by suitable means such as suitable adhesive 70 whereupon the disc 57 is fixed in position against the inner surface 31 of the bottom wall 24 by adhesive 71 as shown in FIG. 7.

The tabs 67 associated with the bottom wall 24, once folded perpendicular to their associated walls 63, define a cross-shaped structure also designated by the reference numeral 68 at the bottom of the shaft 60. The bottom wall 24 is provided with a corresponding cross-shaped cutout 72 which is adapted to receive the set 68 of flanges 67 therein whereby the tubular shaft 60 is fixed in position perpendicular to the bottom wall 24 once the bottom surface of the disc 57 is fixed against the inner surface 31 of the bottom wall 24 by the adhesive 71. Thus, it is seen that the reel 22 may be made a part of the pallet-type support means or bottom wall 24 by fixing the shaft 60 which supports such reel to the bottom wall 24 and then suitably attaching the reel 22 in position about the tubular shaft 60.

As previously mentioned the package construction 20 has holding means thereon for preventing axial movement of the reel 22 away from bottom wall 24 in the form of a disc 61 and the top set 74 of rectangular tabs 67. The tabs 67 of top set 74 are folded in position perpendicular to their end portion 66 of the tubular shaft 60 after placing the reel 22 on the shaft by extending such shaft through the tubular central core 44. The disc 61 is then installed in position and the tabs 67 of the top set 74 folded in position thereover and adhesively fastened against disc 61 by adhesive 70, FIG. 7.

Figure 3:
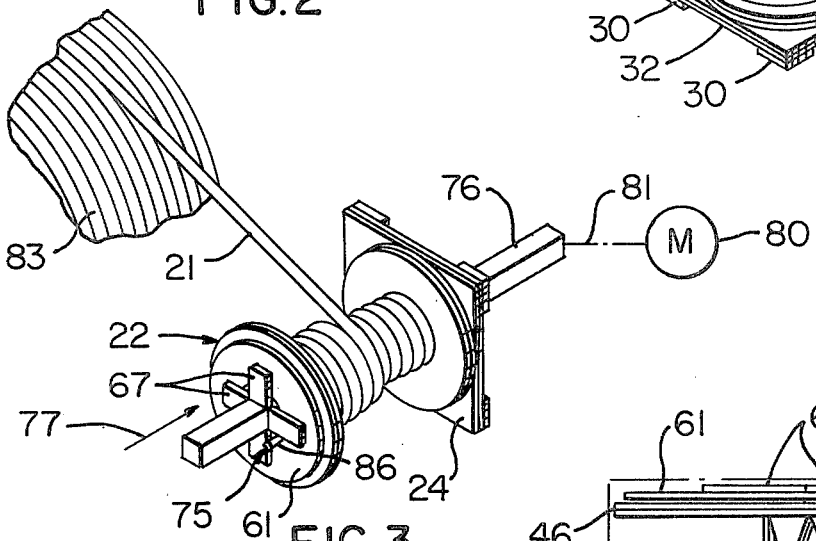
FIG. 3 is a perspective view with parts broken away and parts shown schematically illustrating the manner in which coilable material may be wound on the reel of FIG. 1 from a supply thereof.
Figure 4:
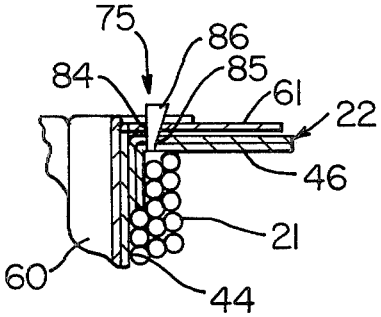
FIG. 4 is a fragmentary view with parts in cross section and parts broken away particularly illustrating locking means locking the reel to a support shaft for such reel during coiling of the coilable material thereon as shown in FIG. 3.

The package construction 20 also comprises means locking the reel 22 to the shaft 60 to prevent relative rotation therebetween and such means is designated generally by the reference numeral 75 and shown in FIGS. 3 and 4. The locking means 75 is particularly adapted to hold the reel 22 and shaft 60 as a unit during the coiling of the coilable material, such as hose 21, thereon. For example, as shown in FIG. 3, the reel 22 with its attached bottom wall-pallet 24 may be suitably supported on a rotatable mandrel 76 which is supported in a cantilevered manner and enables the reel 22 with its bottom wall 24 to be inserted over the mandrel 76 as shown by the arrow 77 in FIG. 3. The mandrel 76 is of rectangular cross-sectional outline and may be suitably rotated by a drive motor 80 which is connected by a suitable mechanical connection 81 to the mandrel 76 and in a manner known in the art and with the locking means 75 in position rotation of the mandrel 76 provides simultaneous rotation of the bottom wall 24 and reel 22.

The reel 22 has the hose 21 wound thereon by attaching a leading end of such hose to the central core 44. The shaft 60 with the reel 22 locked thereon is then rotated by motor 80 while supplying hose 21 from a supply roll 83 thereof which is supported, as is known in the art, for unwinding rotation. Suitable means (not shown) may be provided for guiding the hose 21 back and forth across the axial length of the reel 22 to enable winding of hose 21 in position in a plurality of concentric layers.

Although any suitable means may be employed to define the locking means 75, such locking means is preferably defined by an opening 84 in the member or top disc 61 and an opening 85 in the adjacent double thickness flange 46. The aligned openings 84 and 85 are adapted to receive a resilient yieldable wedge 86 therethrough whereby edge portions of the material defining the opening 84 in member 61 and similar edge portions of the material defining the opening 85 in the associated flange 46 receive the wedge 86 in wedged relation thereagainst to thereby hold the wedge itself in locked relation during coiling of the hose 21 in the manner illustrated in FIG. 3. The wedge 86 is preferably retained in its wedged position within openings 84 and 85 at all times except during dispensing of hose 21 by unwinding rotation of reel 22 about the shaft 60.

The container 23 comprising the package construction 20 is preferably of non-circular cross-sectional outline when viewed on a cross section perpendicular to the longitudinal axis which is disposed normal to the open end 29. Preferably such cross-sectional outline is a polygonal outline in the form of a rectangle; and, in this example the container 23 is in the form of a rectangular parallelepiped with the pallet-like bottom wall 24 defining one of the walls of such parallelepiped. However, it is to be understood that the container 23 of package construction 20 may have any other desired configuration which facilitates handling, stacking, and storage a plurality of package constructions.

Figure 11:
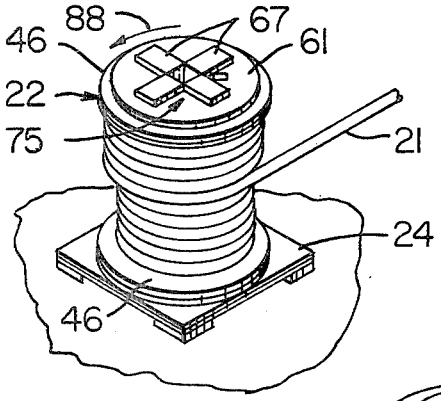
FIG. 11 is a perspective view illustrating one technique which may be employed in unwinding the coilable material from the reel of FIG. 1.

The package construction 20 with the rotatable reel 20 provided as an integral part thereof lends itself to unwinding rotation and dispensing action merely by removing the fastening tape 36 and lifting the open ended tubular construction 28 away from the bottom wall 24 thereby exposing the reel 22 on the wall-pallet 24, as shown in FIG. 11. The dispensing or unwinding of hose 21 is then simply achieved by pulling on the free end thereof, after removal of the locking wedge 86, to provide rotation of the reel 22 about shaft 60 as shown by arrow 88. To facilitate unwinding rotation while still providing a construction of optimum economy the member or disc 57 fixed to bottom wall 24 may be made of a suitable anti-friction material and similarly the bottom retaining flange 46 and/or its disc engaging surface may also be made of a suitable anti-friction material.

Figure 12:
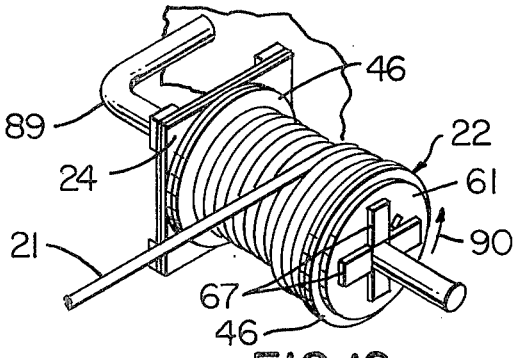
FIG. 12 is a perspective view illustrating another technique which may be employed in unwinding the coilable material from the reel of FIG. 1.

The dispensing of the hose 21 from the reel 22 may also be achieved employing a conventional dispensing technique and an example of such a technique is shown in FIG. 12. In particular, the bottom wall-pallet 24 with the reel 22 thereon may be supported on a suitable spindle 89 as shown in FIG. 12. The spindle 89 may be provided with anti-friction bearing means, or the like, and the unwinding rotation achieved, as shown by arrow 90, with the wedge 86 in locking engagement.

The dual-purpose bottom wall-pallet 24, open-ended tubular construction 28, reel 22, and shaft 60 of the package construction 20 are preferably made primarily of a non-metallic inexpensive material such as paper, including corrugated paperboard. However, it will be appreciated that such components of the package construction 20 need not necessarily be made of paper and as will now be described.

Figure 13:
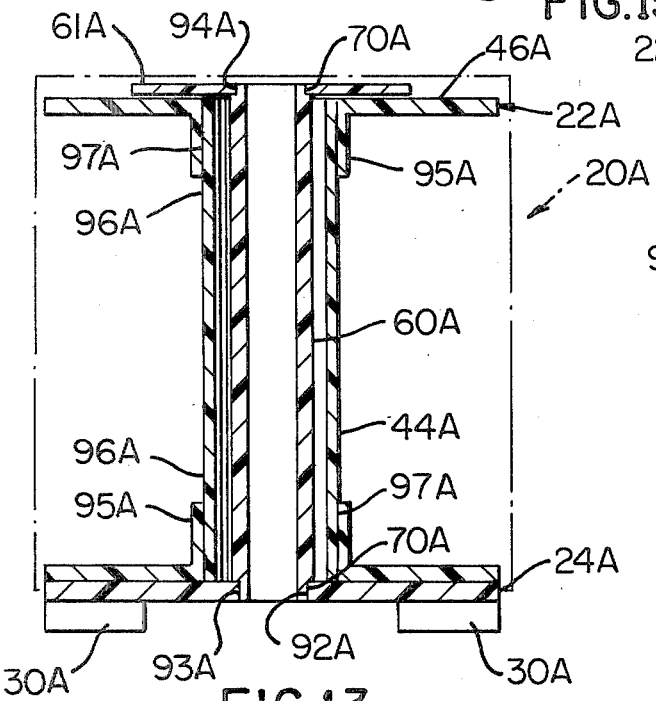
FIG. 13 is a cross-sectional view similar to FIG. 7 illustrating another exemplary embodiment of the package construction of this invention and also showing by dot-dash lines an open-ended tubular construction thereof which is disposed in position around the reel.
Figure 14:
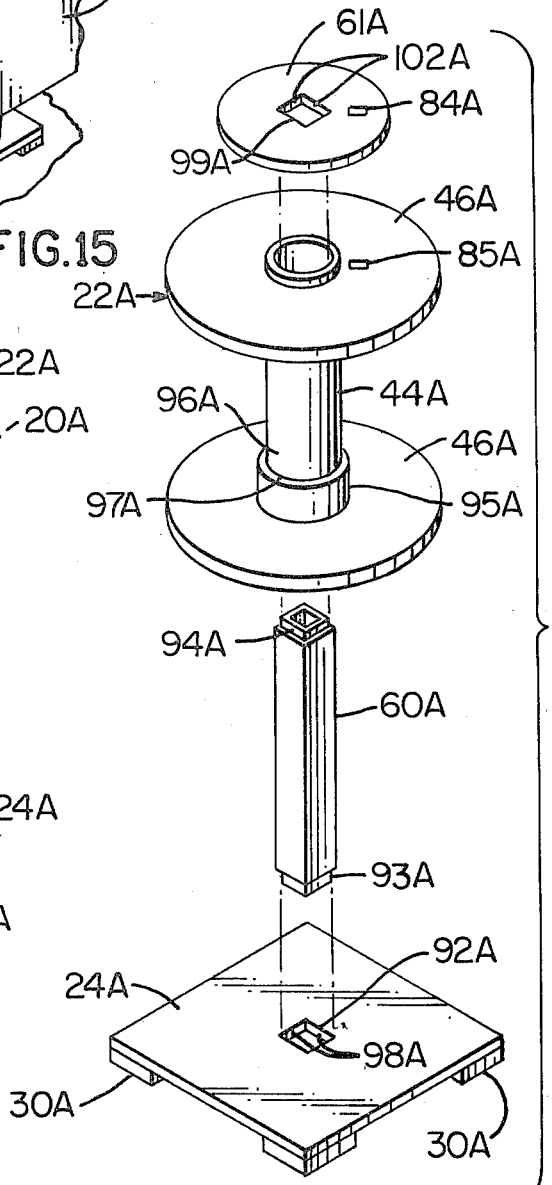
FIG. 14 is a view similar to FIG. 8 showing corresponding components of the embodiment of the package construction shown in FIG. 13.

Another exemplary embodiment of the package construction of this invention is illustrated in FIGS. 13 and 14 of the drawing. The package construction of FIGS. 13 and 14 is very similar to the package construction 20; therefore such package construction will be designated by the reference numeral 20A and representative parts of such package construction which are similar to corresponding parts of the package construction 20 will be designated in the drawings by the same reference numerals as in the package construction 20 (whether or not such parts are mentioned in the specification) followed by the letter designation A and not described in detail.

The package construction 20A comprises pallet-type support means or a dual-purpose bottom wall-pallet 24A which has integral feet 30A; and, the support means 24A with its feet 30A may be made of polymeric material such as a synthetic plastic material. The bottom wall 24A also has a central rectangular opening 92A extending therethrough.

The tubular shaft 60A has a necked down end portion 93A of rectangular outline at its lower end and another necked down end portion 94A also of rectangular outline at its upper end; and, as seen in FIG. 13 the portion 93A is adapted to be received in the opening 92A in bottom wall 24A and suitably fixed in position by adhesive means 70A between cooperating surfaces 98A in bottom wall 24A, which define opening 92A, and end portion 93A.

The reel 22A has a tubular central core 44A and a pair of retaining flanges 46A at opposite ends thereof with the tubular central core 44A and flanges 46A being made of any suitable polymeric material, such as synthetic plastic material. Each of the retaining flanges 46A has a tubular sleeve 95A defined as an integral part thereof as a single-piece structure and it will be seen that each sleeve 95A is telescoped in position around an associated end portion 96A of the tubular central core 44A. The reel 22A has suitable means such as adhesive means 97A which is used to fix each sleeve 95A in position to thereby fix the flanges 46A in position on the reel 22A.

The reel 22A is disposed so that the shaft 60A of the package construction 20A is telescoped through the longitudinal opening in the tubular central core 44A and the necked down portion 94A at the upper end of shaft 60A extends above the reel 22A. A disc-like member 61A is then suitably adhesively fixed in position against necked down portion 94A by adhesive means 70A between the upper portion 94A and cooperating surfaces 102A of member 61A which define an opening 99A which receives portion 94A therethrough.

It will also be appreciated that openings 84A and 85A are provided in the disc 61A and associated upper flange 46A respectively for insertion of a wedge similar to the wedge 86 therethrough for the purpose previously described.

As shown by cross-hatching symbol in FIG. 13 of the drawings, the dual purpose bottom wall-pallet 24A, shaft 60A, reel 22A, and holding means comprised of member 61A for holding such reel in position against axial movement may be made primarily of synthetic plastic material.

An open ended tubular construction may be provided which is similar to the construction 28 and such construction is shown in FIG. 13 by dot-dash lines and designated by the reference numeral 28A. The construction 28A may be made of a suitable synthetic plastic material; however, it will be appreciated that such construction may be made of any material employed in the art, such as paper, and as described previously for the construction 28.

The bottom wall 24A and the bottom flange 46A of reel 22A disposed thereagainst may be made of a suitable synthetic plastic material having anti-friction properties such as polyethylene, or the like, to facilitate unwinding rotation whether the reel 22A is used to dispense hose 21 in the manner shown in FIG. 11 or in the manner shown in FIG. 12.

Figure 15:
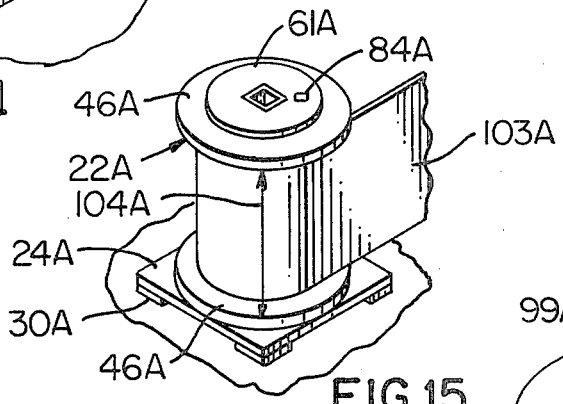
FIG. 15 is a view similar to FIG. 11 showing the construction of FIG. 13 used to dispense coilable material in the form of coilable sheet material.

A modification of the package construction of this invention is illustrated in FIG. 15 of the drawings and such modification is basically the construction of FIG. 13 comprised of a bottom wall or base 24A with reel 22A rotatably supported thereon. The construction of FIG. 15 is used for the purpose of packaging and dispensing coilable material in the form of a coilable sheet 103A. The coilable sheet may be a sheet of polymeric material such as synthetic plastic or rubber, wall paper, fabric, carpet material, carpet underlay, and the like. The sheet 103A is of sufficiently narrow width so that the height 104A of the spool 22A associated therewith enables unwinding rotation in the manner shown in FIG. 11 without likelihood of toppling of the spool 22A and its base 24A. In some applications it may also be desirable to make the base 24A of a comparably heavy material in either the main part of the base or the feet 30A thereof to prevent the likelihood of toppling.

In addition, it will be appreciated that a spool 22A of the sheet material 103A may be suitably supported for unwinding rotation on a mandrel similar to the mandrel 89 and as shown in FIG. 12. Further, the spool of FIG. 15 with sheet material thereon may also be provided with an open-ended tubular construction 28A thereon, as previously described.

In this disclosure of the invention each package construction 20 and 20A has been described as being made primarily of paper or of synthetic plastic material respectively; however, it is to be understood that such package construction or similar construction may be made of any suitable material known in the art and employed for this purpose.

It will also be seen that each tubular shaft 60 and 60A is shown as a shaft of non-circular rectangular outline; however, it is to be understood that each shaft may have a circular outline if desired and may be provided with suitable anti-friction means or suitable bearing means to facilitate rotation of the reel about its associated shaft. Similarly, suitable bearing means may be provided between each reel and its pallet-type support means to facilitate relative anti-friction rotation between such reel and support means.

While present exemplary embodiments of this invention, and methods of practicing the same, have been illustrated and described, it will be recognized that this invention may be otherwise variously embodied and practiced within the scope of the following claims.

What is claimed is:

1. In a package construction for coilable material comprising a reel for coiling said coilable material thereon and a container for containing said reel, said container comprising a plurality of walls; the improvement wherein said reel is made as a part of one of said walls, said one wall having an inner surface and an outer surface, a plurality of feet attached against said outer surface, said one wall with its feet defining a pallet for said container and its reel; said reel disposed substantially centrally on said one wall, said container comprising tubular construction having an open end, said tubular construction being disposed around said reel with the terminal edge of said open end above said outer surface.

2. In a construction as set forth in claim 1 the further improvement in which said one wall has an inner surface, and said reel comprises a central core having a pair of opposite ends and a pair of substantially planar retaining flanges for said coilable material fixed to said opposite ends in substantially parallel relation, one of said flanges being disposed immediately adjacent an inner surface of said one wall.

3. In a construction as set forth in claim 2 the further improvement comprising means supporting said reel for rotation relative to said one wall.

4. In a construction as set forth in claim 3 the further improvement in which said supporting means slideably supports said one flange on said one wall for rotation relative thereto.

5. In a construction as set forth in claim 3 the further improvement in which said supporting means comprises a support shaft attached to said pallet, said central core comprises a hollow core having said shaft disposed therethrough, and further comprising means holding said reel on said shaft against axial movement.

6. In a construction as set forth in claim 5 the further improvement in which said support shaft is a tubular shaft.

7. In a construction as set forth in claim 6 the further improvement in which said tubular shaft is of rectangular outline and made of a foldable material defining four walls thereof, said shaft having four axially extending slits along the four corners at one end portion thereof defining four fastening tabs, each of said fastening tabs being folded perpendicular to its associated wall and attached to said one wall.

8. In a construction as set forth in claim 6 the further improvement in which said tubular shaft is of rectangular outline and made of a foldable material, said shaft having four axially extending slits along four corners at each end portion thereof, each of said four slits at each of said end portions defining a set of four fastening tabs, one of said set of fastening tabs being folded perpendicular to its associated wall and attached to said one wall to attach said shaft thereto and the other of said set of fastening tabs being folded perpendicular to its end portion after installing said reel in telescoped relation around said shaft to define said means holding said reel on said shaft against axial movement.

9. In a construction as set forth in claim 5 the further improvement in which said pallet, tubular container, reel, and shaft are made primarily of non-metallic material.

10. In a construction as set forth in claim 9 the further improvement in which said non-metallic material comprises paper.

11. In a construction as set forth in claim 9 the further improvement in which said non-metallic material comprises a polymeric material.

12. In a construction as set forth in claim 5 the further improvement in which said retaining flanges of said reel are made from circular discs which have a plurality of slits therein extending radially from the center thereof, said slits in each disc defining triangular wedges which are adapted to be folded about their bases perpendicular to the peripheral portion of their disc, and means fixing said wedges of each disc to said central core to define the flanges of said reel.

13. In a construction as set forth in claim 12 the further improvement in which said retaining flanges are made of paper circular discs.

14. In a construction as set forth in claim 5 the further improvement in which each of said flanges has a tubular fastening sleeve defined as an integral part thereof, each sleeve being telescoped around an associated end portion of said central core, and means fixing said sleeve to said central core to thereby fix the flanges of said reel in position on said core.

15. In a construction as set forth in claim 14 the further improvement in which each of said fastening sleeves and its flange is made of a synthetic plastic material as a single-piece structure.

16. In a construction as set forth in claim 5 the further improvement in which said tubular construction is of non-circular cross-sectional outline when viewed on a cross section perpendicular to a longitudinal axis disposed perpendicular to said open end.

17. In a construction as set forth in claim 5 the further improvement in which said tubular construction is a polygonal cross-sectional outline when viewed on a cross section perpendicular to a longitudinal axis disposed perpendicular to said open end.

18. In a construction as set forth in claim 5 the further improvement in which said tubular construction is in the shape of a rectangular parallelepiped having said open end.

19. In a construction as set forth in claim 5 the further improvement comprising at least one fastener fastening said tubular construction in position with its open end disposed around said one wall.

20. In a construction as set forth in claim 5 the further improvement in which said means holding said reel on said shaft comprises a member fixed to said shaft with said reel disposed inwardly of said member between said member and said one wall, and further comprising means locking said reel to said shaft to prevent relative rotation therebetween during coiling of said coilable material thereon.

21. In a construction as set forth in claim 20 the further improvement in which said locking means comprises a plurality of aligned openings in said member and an adjacent flange and a resilient wedge adapted to be inserted through said aligned openings.

22. In a method of packaging and dispensing a coilable material comprising the steps of, coiling said coilable material on a reel, disposing said reel with its coilable material thereon in a container having a plurality of walls, removing said reel from within said container, supporting said reel on a support after removal thereof from within said container to enable unwinding of said coilable material and dispensing thereof from said reel, the improvement comprising the steps of, making said reel as a part of a pallet-type wall of said container and the remainder of said container as an open-ended tubular construction, said pallet-type wall supporting said reel and container for handling and storage purposes, and said pallet-type wall after removal of said open-ended tubular construction supporting said reel for rotation relative thereto.

23. In a method as set forth in claim 22 the further improvement comprising providing a plurality of feet on said pallet-type wall defining a space between said pallet-type wall and a floor therebeneath, said space being adapted to receive lifting members of a lifting device therein.

* * * * *